United States Patent [19]

Yagi et al.

[11] Patent Number: 4,934,348

[45] Date of Patent: Jun. 19, 1990

[54] VALVE OPERATION CONTROL SYSTEM OF INTERNAL COMBUSTION ENGINE

[75] Inventors: Toru Yagi; Kaname Tokita, both of Saitama, Japan

[73] Assignee: Honda Giken Kogyo Kabushiki Kaisha, Tokyo, Japan

[21] Appl. No.: 366,139

[22] Filed: Jun. 14, 1989

[30] Foreign Application Priority Data

Jun. 14, 1988 [JP] Japan ..... 63-146361

[51] Int. Cl.[5] ..... F01L 1/34

[52] U.S. Cl. ..... 123/90.16; 123/90.17

[58] Field of Search ..... 123/90.11, 90.15, 90.16, 123/90.17, 90.44, 90.47, 90.31

[56] References Cited

U.S. PATENT DOCUMENTS

| | | | |
|---|---|---|---|
| 4,387,680 | 6/1983 | Tsunetomi et al. | 123/198 F |
| 4,494,495 | 1/1985 | Nakamura et al. | 123/90.17 |
| 4,556,025 | 12/1985 | Morita | 123/90.16 |
| 4,711,207 | 12/1987 | Bonvallet | 123/90.16 |
| 4,719,882 | 1/1988 | Kreuter | 123/90.11 |
| 4,811,698 | 3/1989 | Akasaka et al. | 123/90.31 |

FOREIGN PATENT DOCUMENTS 3347533 7/1985 Fed. Rep. of Germany ... 123/90.13

*Primary Examiner*—Charles J. Myhre
*Assistant Examiner*—Weilun Lo
*Attorney, Agent, or Firm*—Lyon & Lyon

[57] ABSTRACT

A valve operation control system for an internal combustion engine having an engine valve supported in an engine body for opening and closing. A phase control means is interposed between a crankshaft and the valve operating cam shaft to control the rotating phase of the crankshaft relative to the valve operating cam shaft. A valve drive means is interposed between the valve operating cam and the engine valve to transmit the valve opening force by the valve operating cam to the engine valve. The valve drive means includes a resilient valve opening means for generating resilient force in the valve opening direction and a holding means for holding the engine valve in a closed position while springs accumulate the valve opening force. The holding means is selectively operable to switch between a valve holding state and a valve releasing state to control the valve opening timing of the engine valve in response to operating conditions of said engine.

11 Claims, 12 Drawing Sheets

VALVE OPERATION CONTROL SYSTEM OF INTERNAL COMBUSTION ENGINE

The present invention relates to a valve operation control system for the intake and exhaust valves of an internal combustion engine and, in particular, to a system for controlling the phase or timing of the opening of the valves relative to the crankshaft and the camshaft.

There are prior art valve operation control systems wherein a phase control mechanism is interposed between the crankshaft and the valve operating cam shaft for controlling the rotating phase of the crankshaft relative to the valve operating cam shaft to thereby control the valve opening timing relative to the crankshaft. Such a valve operation control system is conventionally known, for example, from Japanese patent application Laid-Open No. 145310/86. In this prior art system, the rotating phase of the crankshaft and the valve operating cam shaft is varied by phase control means to control its valve opening timing, the lifting distance of the engine intake or exhaust valve is variably controlled by valve drive means to establish the preferred operating mode of the engine valve for the operating state of the engine. However, in such prior art system, the valve opening timing of the engine valve is merely displaced with respect to the rotating angle of the crankshaft but the valve opening timing of the engine valve is constant with respect to the rotating angle of the valve operating cam shaft.

It is an object of the present invention to provide a valve operation control system for the engine intake and exhaust valves of an internal combustion engine wherein the rotating phase of the valve operating cam shaft with respect to the crankshaft is controlled and the valve opening timing of the engine valve with respect to the rotating angle of the valve operating cam shaft also is controlled to increase the degree of freedom of controlling the valve.

To attain the above object, according to the present invention, there is provided a valve operation control system for an internal combustion engine having an engine intake or exhaust valve supported in an engine body for opening and closing, a valve spring for biasing the engine valve in a valve closing direction, valve drive means interposed between a valve operating cam and the engine valve for transmitting a valve opening force to the engine valve by the valve operating cam provided on a valve operating cam shaft, and phase control means interposed between a crankshaft and the valve operating cam shaft for controlling the rotating phase of the crankshaft and the valve operating cam shaft, wherein the valve drive means comprises a resilient valve opening means for generating a resilient force in the valve opening direction of the engine valve, a holding means interposed between the engine valve and the valve operating cam for holding the engine valve at a valve closing position while accumulating the valve opening force by the valve operating cam in the resilient valve opening means, and the holding means is constructed to be able to switch between the holding state and the hold-releasing state so as to control the valve opening timing of the engine valve in response to the operating condition of the engine.

According to the present invention, the rotating phase of the crankshaft and the valve operating cam shaft can be variably controlled by the phase control means, the valve closing position of the engine valve is held by the holding means, the timing for releasing the holding state is independently selected to variably control the valve opening timing with respect to the valve operating cam shaft of the engine valve, and the degree of freedom of controlling can be increased in combination with both the controls.

An embodiment of the present invention will now be described with reference to the accompanying drawings, wherein.

Figure 4A:
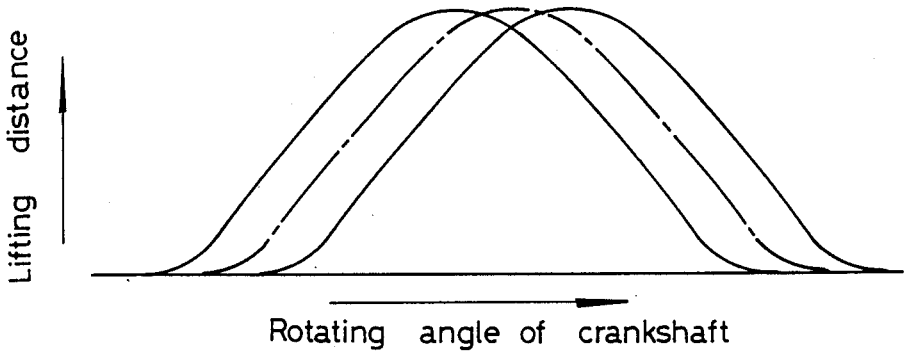
Figure 4B:
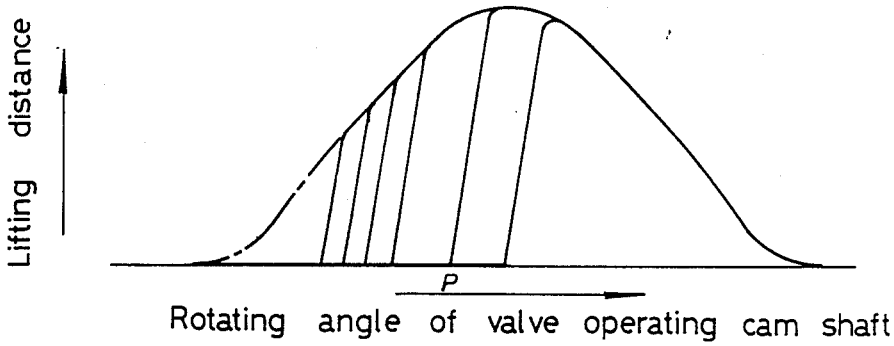
Figure 4C:
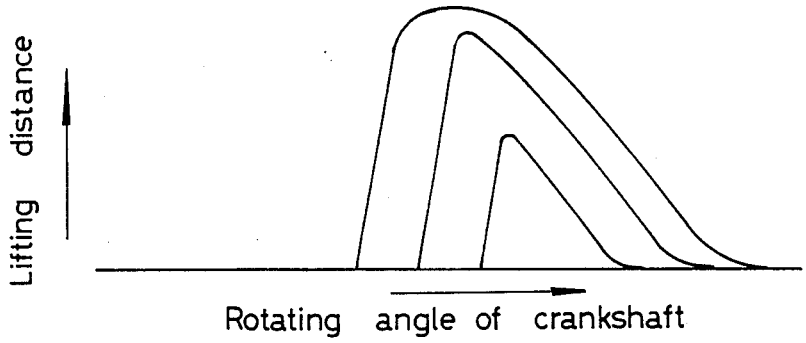

FIGS. 4(*a*), 4(*b*) and 4(*c*) are diagrams showing the relationship between the valve opening lifting distance and the rotating angle of the crankshaft and the valve operating cam.

Figure 3:
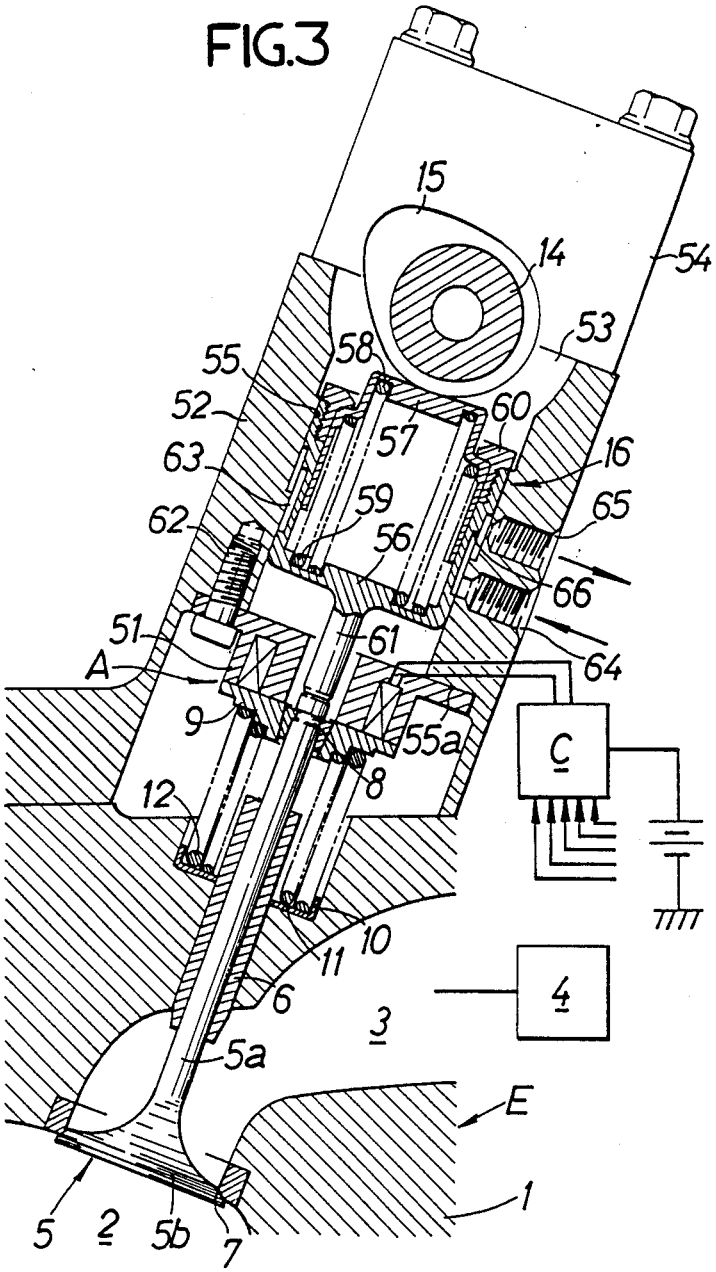
FIG. 3 is an enlarged sectional elevation end view of the valve drive means of the first embodiment.
Figure 5:
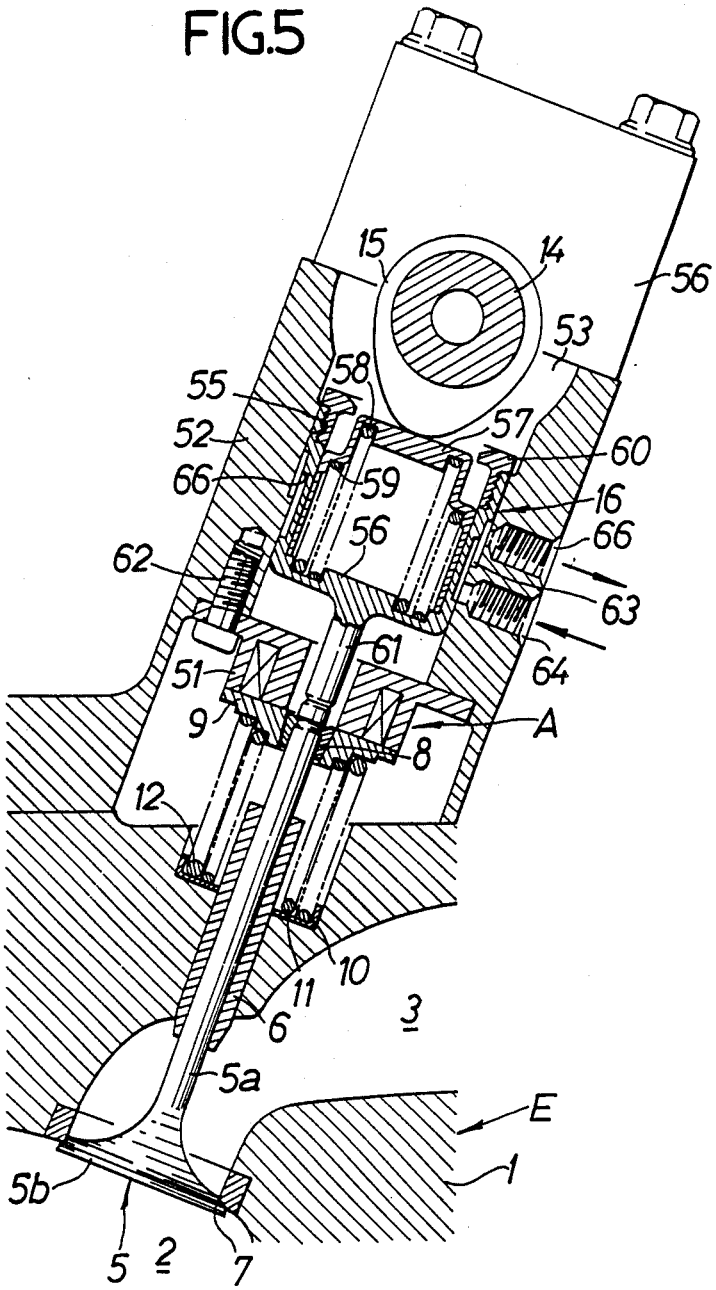

FIG. 5 is a sectional elevation end view corresponding to FIG. 3 showing the valve closing position holding state of the holding means.

Figure 6:
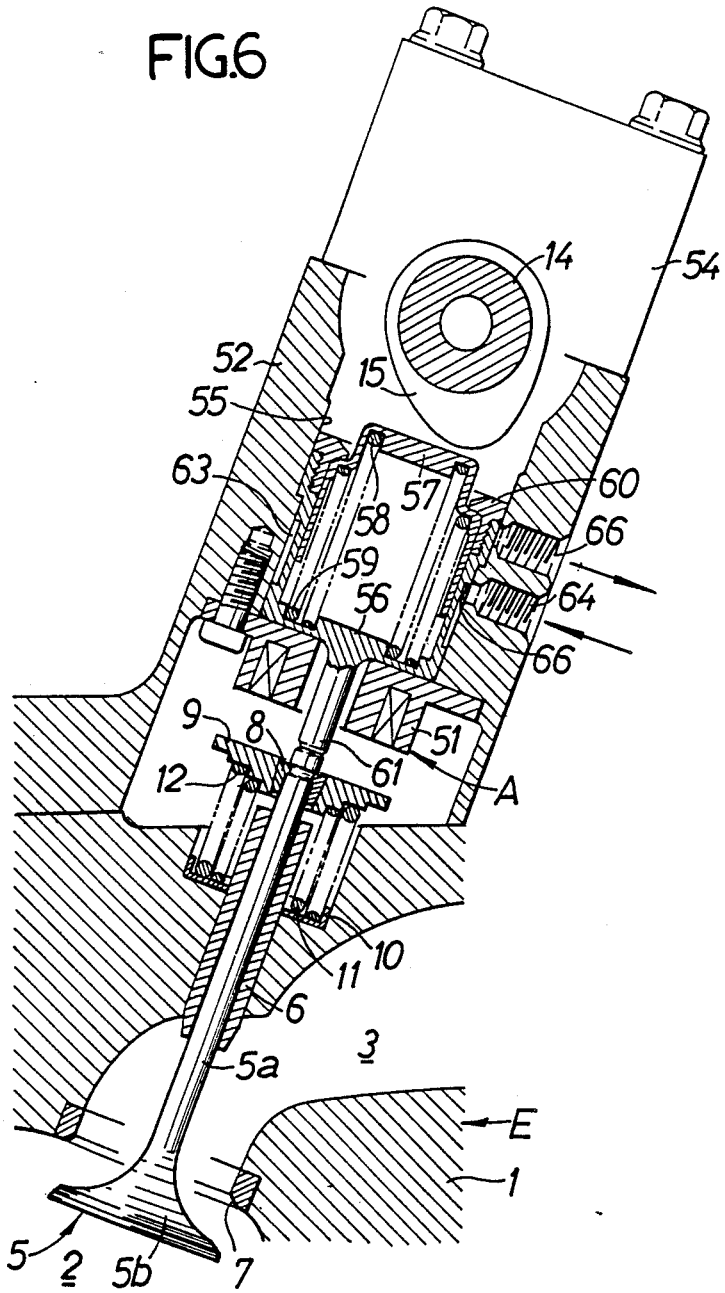

FIG. 6 is a sectional elevation end view corresponding to FIG. 3 showing the hold-releasing state of the holding means.

Figure 7:
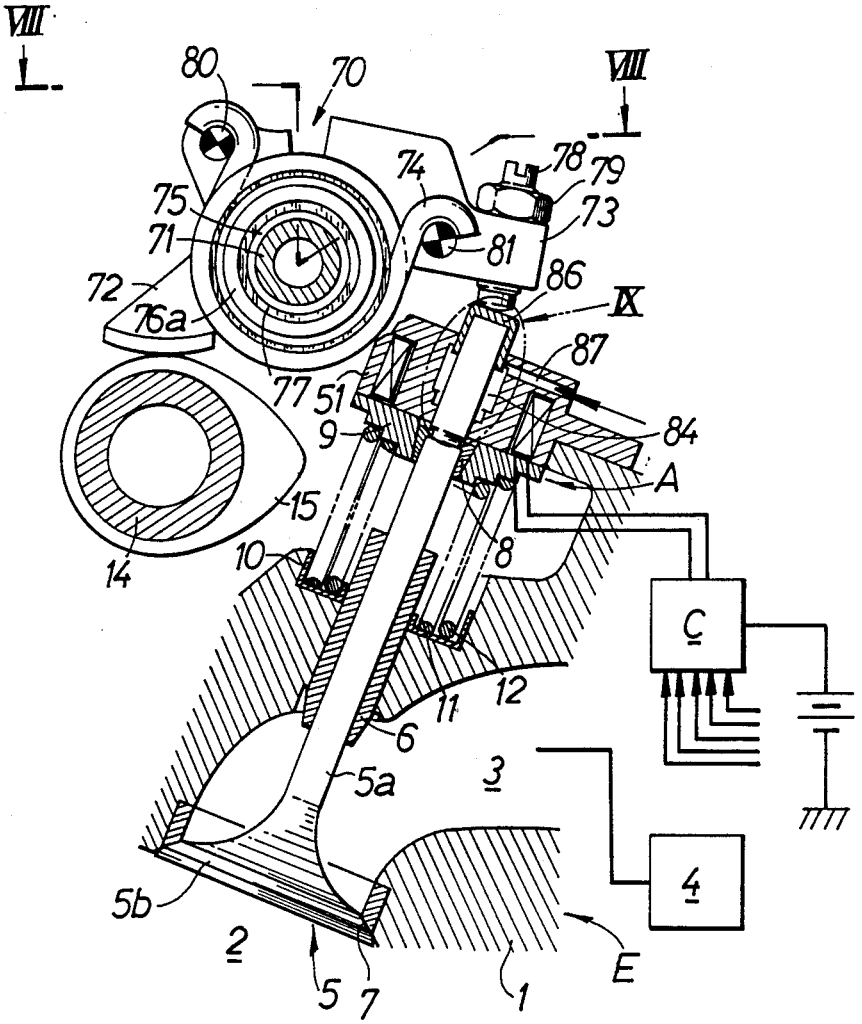

FIG. 7 is a sectional elevation end view of the valve drive means of a second embodiment of the present invention.

Figure 8:
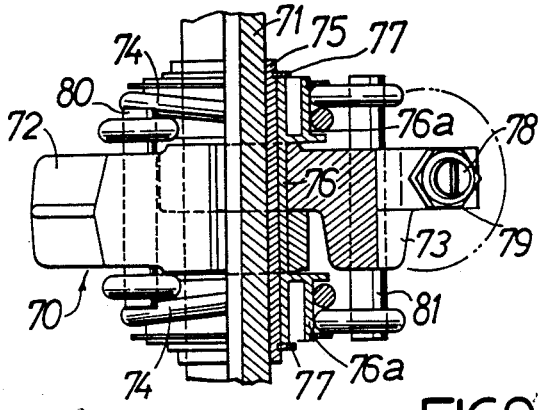

FIG. 8 is a sectional plan view taken along the line VIII—VIII of FIG. 7.

Figure 9:
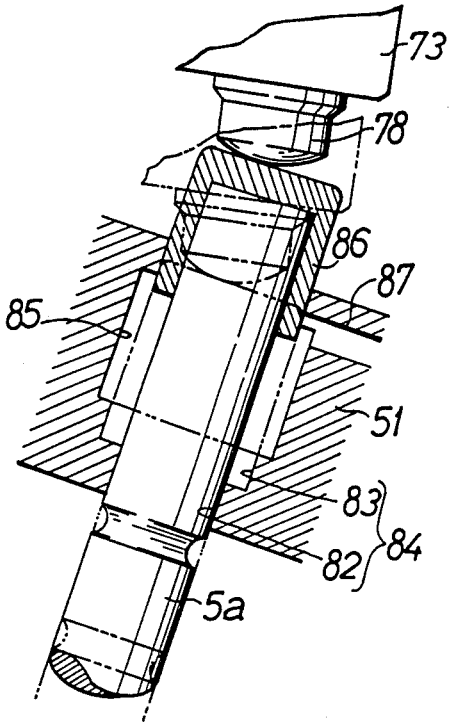

FIG. 9 is an enlarged view of a portion of FIG. 7 encircled by dashed lines identified by the arrow IV of FIG. 7.

Figure 10:
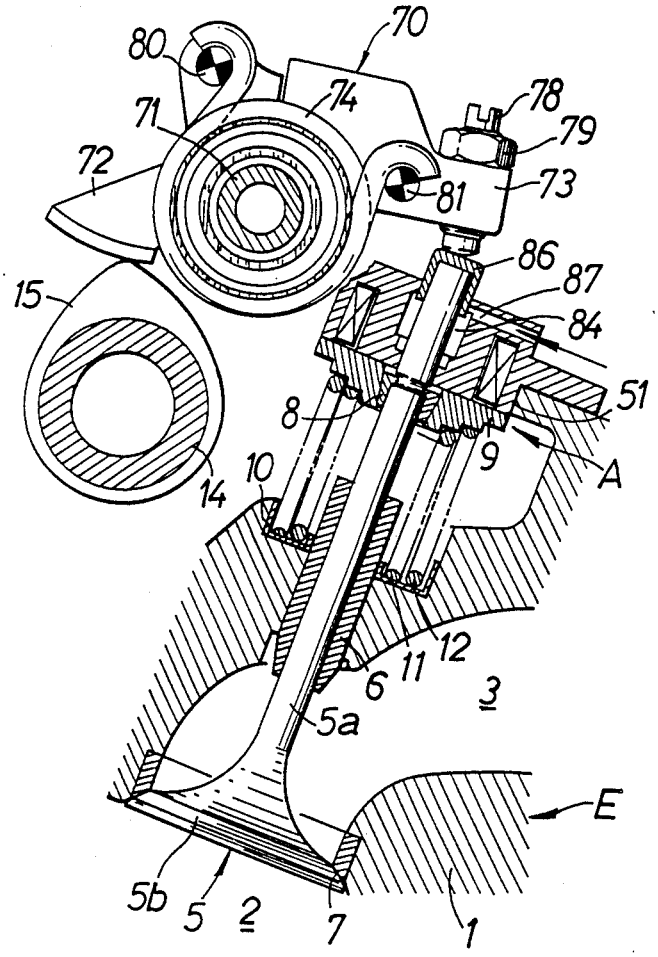

FIG. 10 is a sectional elevation end view corresponding to FIG. 7 showing the valve closing position holding state of the holding means.

Figure 11:
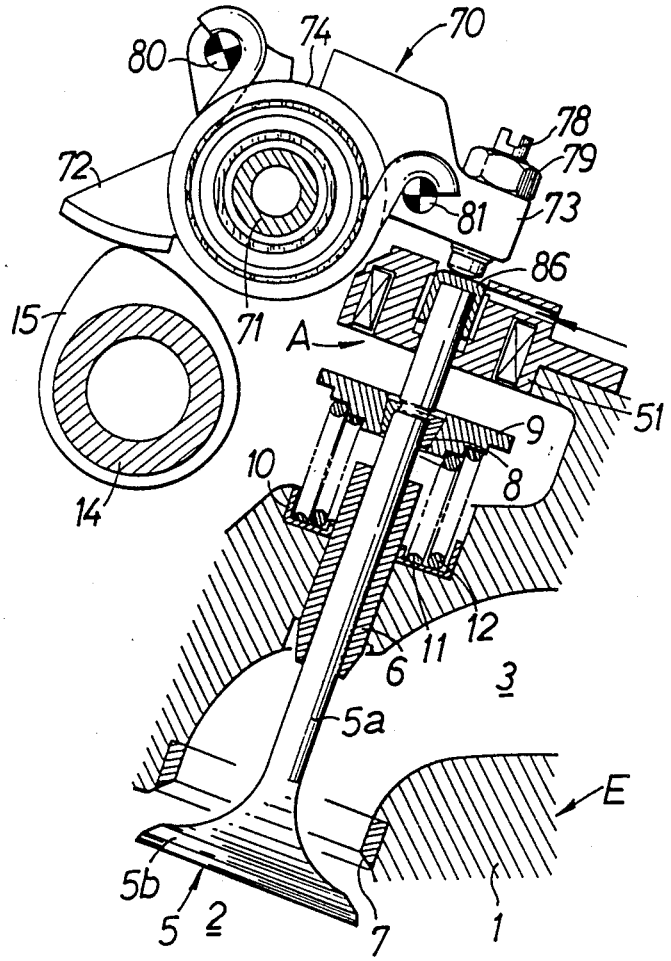

FIG. 11 is a sectional elevation end view corresponding to FIG. 7 showing the hold-releasing state of the holding means.

Figure 12:
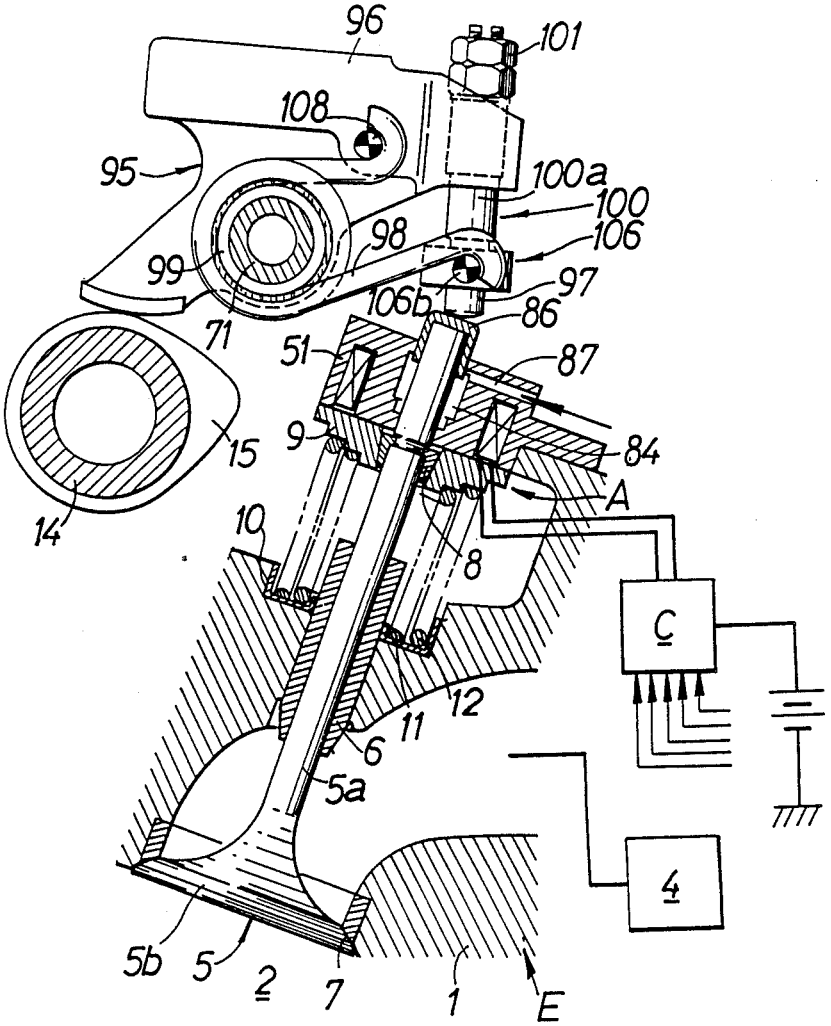

FIG. 12 is a sectional elevation end view of the valve drive means of a third embodiment of the present invention.

Figure 13:
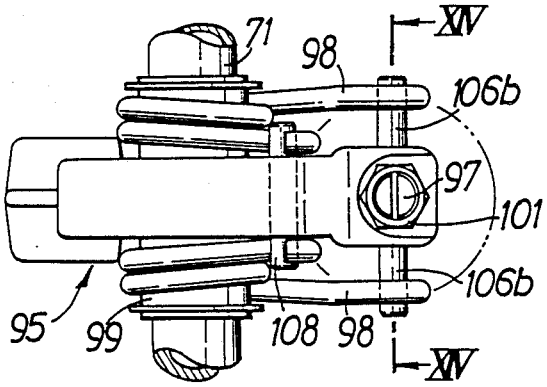

FIG. 13 is a plan view of FIG. 12; and

Figure 14:
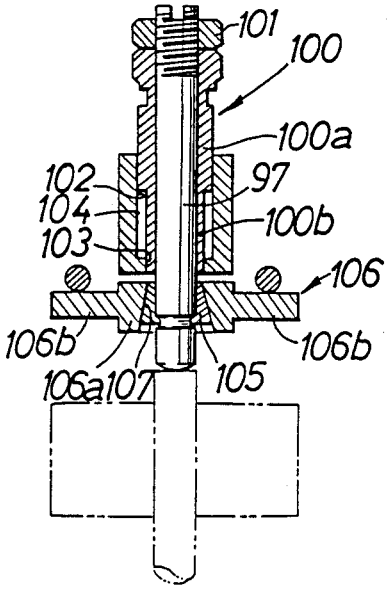

FIG. 14 is a sectional elevation view taken along the line XIV—XIV of FIG. 13.

Figure 1:
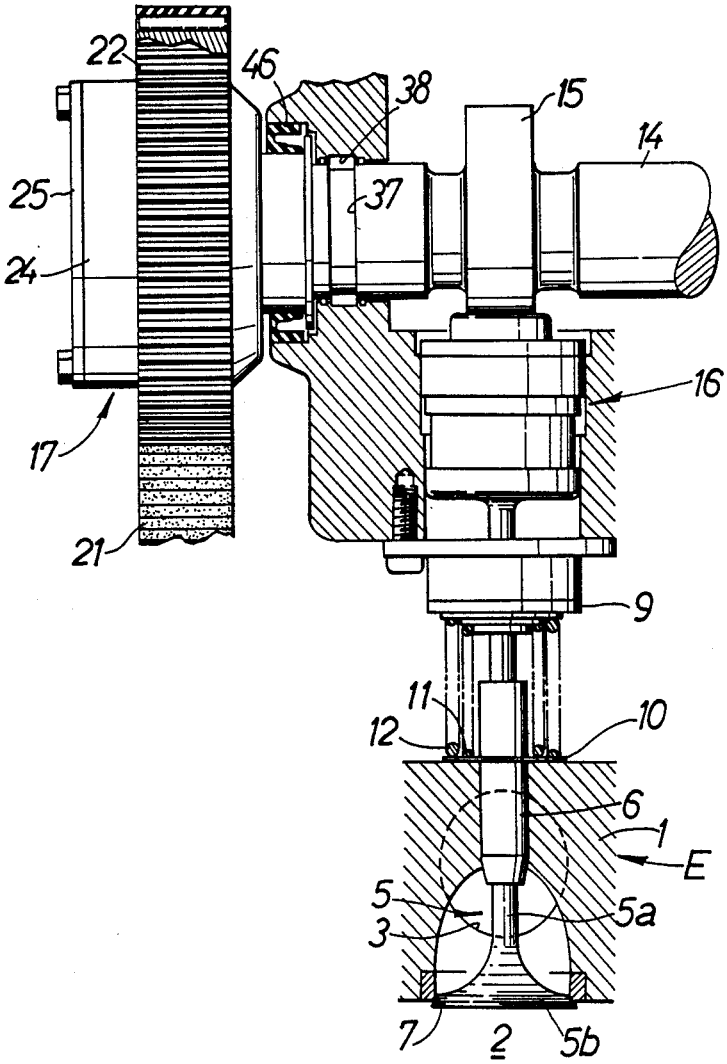
FIG. 1 is a longitudinal section elevation side view showing phase control means and valve drive means of a first embodiment of the present invention.

In FIG. 1, showing the first embodiment of the present invention, a cylinder head 1 of an engine body E is formed with a combustion chamber 2 and an intake port 3 communicating with the combustion chamber 2. An intake engine valve 5 capable of opening and closing the open end of the intake port 3 at the side of the combustion chamber 2 is supported in the cylinder head 1. The intake valve 5 has a valve stem portion 5*a* and a valve body portion 5*b*. The valve stem portion 5*a* is slidably fitted in a valve guide 6 fixed to the cylinder head 1, and the valve body portion 5*b* is capable of being seated on a valve seat 7 at the open end of the intake port 3 at the side of the combustion chamber 2. A spring retainer 9 is mounted at the upper end of the valve stem portion 5*a*. Valve springs 11 and 12, comprising compression coil springs, are provided in compression between the spring retainer 9 and a spring seat 10 formed at the cylinder head 1 and the resilient forces of the valve springs 11 and 12 urged the intake valve 5 in a valve closing direction.

A valve operating cam shaft 14 is rotatably supported on the upper portion of the cylinder head 1 by a cam shaft holder (not shown) mounted on the cylinder head 1. The valve operating cam shaft 14 is operatively connected to the engine crankshaft (not shown) through a phase control means 17. Valve drive means 16 for transmitting the valve opening force of the intake cam 15 on cam shaft 14 to the intake valve 5 is interposed between the intake cam 15 and the intake valve 5.

Figure 2:
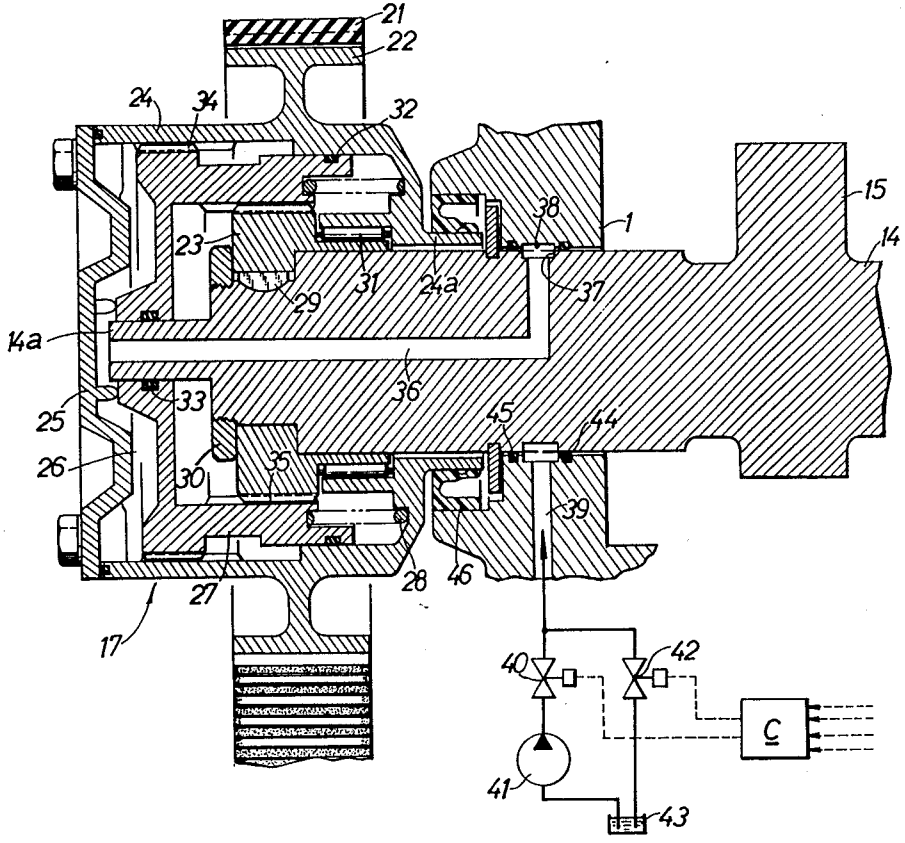
FIG. 2 is an enlarged sectional elevation view of the first embodiment.

Referring also to FIG. 2, the phase control means 17 includes a pulley 22 engaged by a timing belt 21 that also engages a pulley (not shown) on the crankshaft for transmitting the rotary power from the crankshaft. A rotary shaft 23 is connected coaxially with the valve operating cam shaft 14. A bottomed cylindrical housing 24 is provided integrally with the pulley 22 to coaxially enclose the end portion of the valve operating cam shaft 14 and the rotary shaft 23. An end plate 25 is mounted on and enclosed the end of the housing 24. A piston 27 is slidably fitted on the valve operating cam shaft 14 and within the housing 24 while defining a hydraulic pressure chamber 26 between the piston 27 and to the end plate 25. A return spring 28 is provided for urging the piston 27 toward the end plate 25 to compress the size of the hydraulic pressure chamber 26.

The rotary shaft 23 is coaxially fixed by a key 29 and a nut 30 to the outer periphery of the end portion of the valve operating cam shaft 14 protruding from the cylinder head 1. The housing 24 has a cylindrical portion **24*a* for enclosing the valve operating cam shaft 14 and the rotary shaft 23 at its end opposite the end plate 25. A bearing 31 is interposed between the rotary shaft 23 and the cylindrical portion 24*a*. Further, the piston 27 is formed of a bottomed cylindrical shape with its closing end at the side of the end plate 25 and its open end, i.e., the outer surface of the end portion at the side of the cylinder head 1, is slidably fitted in the inner surface of the housing 24 and provided with an O-ring 32. The return spring 28 is provided in compression between the closed end of the housing 24 and the open end portion of the piston 27. Further, a shaft portion 14*a* coaxially protrudes from the outer end of the valve operating cam shaft 14 and 14*a* the closed end of the piston 27 has a hole slidably fitted thereon with an O-ring 33 interposed between the shaft portion 14*a* and the piston 27**.

The inner surface of the housing 24 is connected through a helical spline 34 to the outer surface of the piston 27, and the inner surface of the piston 27 is connected through a helical spline 35 to the outer surface of the rotary shaft 23. Accordingly, the crankshaft is connected through the timing belt 21 and pulley 22 to the housing 24 and is displaced in the rotating phase from the rotary shaft 23, i.e., the valve operating cam shaft 14, in response to the axial movement of the piston 27 as a result of the interengaging helical splines 34 and 35.

A hydraulic pressure supply passage 36 for introducing a hydraulic pressure to the hydraulic pressure chamber 26 is provided in the valve operating cam shaft 14 with one end opened to the outer end of the shaft portion **14*a* and the other end opened to the outside surface at a position corresponding to a portion of the cylinder head 1 on which the shaft 14 is mounted. An annular groove 37 is formed on the outer peripheral surface of the valve operating cam shaft 14. An annular groove 38 corresponding to the annular groove 37 is formed on the cylinder head 1, and a passage 39 is provided in the cylinder head 1 in communication with the annular groove 38 and is connected to a hydraulic pressure pump 41 through a solenoid valve 40 and an oil tank 43 through a solenoid valve 42. Annular sealing members 44 and 45 slidably engage the outer surface of the valve operating cam shaft 14 and are fitted in the cylinder head 1 at positions on both sides of the annular grooves 37 and 38. An annular sealing member 46 is interposed between the outer surface of the cylindrical portion of the housing 24 and the cylinder head 1**.

A control circuit C controls the opening and closing operations of both the solenoid valves 40 and 42 in response to the operating state of the engine, in response to detection signals of engine speed, temperature, throttle opening and intake air amount, etc. that are inputted as signals of the operating state of the engine to the control circuit C. The piston 27 of the phase control means 17 is selectively moved to a position where the hydraulic pressure force produced by the hydraulic pressure in the hydraulic pressure chamber 26 and the spring force of the return spring 28 are balanced by controlling the hydraulic pressure of the hydraulic pressure chamber 26 by the operation of both the solenoid valves 40 and 42 to vary the rotating phase of the crankshaft and the valve operating cam shaft 14 in response to the movement of the piston 27.

The construction of the valve drive means 16 will be described with reference to FIG. 3. The intake port 3 communicates with an air intake system which contains a fuel supply device 4. The spring retainer 9 is attached to the upper end of the valve stem portion **5*a* through a cotter 8. The spring retainer 9 is composed of a magnetic material and together with an electromagnetic body 51** comprises an electromagnetic actuator A as holding means.

The valve drive means 16 includes a supporting cylinder 52 extending obliquely upwardly along the axial direction of the intake valve 5 integrally formed with or attached to the cylinder head 1. The valve operating cam shaft 14 is rotatably supported by a bearing half portion 53 formed on the supporting cylinder 52 and a bearing cap 54 fixed onto the upper surface of the bearing half portion 53. An intake cam 15 is provided integrally with the valve operating cam shaft 14 and operates the intake valve 5 through the valve drive means 16.

A hollow cylinder portion 55 is formed in the supporting cylinder 52 and the moving components of the valve drive means 16 are contained in the hollow cylinder portion 55. The valve drive means 16 includes a lifter lower portion 56 of a bottomed hollow cylindrical shape slidably fitted for upward and downward movement in the hollow cylinder portion 55, a cap-shaped lifter upper portion 57 slidably fitted in the lifter lower portion 56 from the open upper portion thereof, and two lifter springs 58 and 59. The springs 58 and 59 serve as resilient valve opening members provided in compression between the lifter lower portion 56 and the lifter upper portion 57. A set nut 60 is threaded into the open upper part of the lifter lower portion 56 and engages the lifter upper portion 57 to restrict the upper limit position of the lifter upper portion 57. A protrusion pin 61 protrudes integrally from the center of the lower surface of the lifter lower portion 56 and the lower end of the protrusion pin 61 abuts against the upper end of the valve stem portion **5*a* of the intake valve 5. The cam surface of the intake cam 15 abuts against the upper surface of the lifter upper portion 57. The resilient forces of the combined lifter springs 58 and 59 are established at a magnitude stronger than those of the combined valve springs 11 and 12. Accordingly, when the valve operating cam shaft 14 is rotated, the intake cam 15 normally presses downwardly on the intake valve 5 through the valve drive means 16, thereby slidably moving it in the valve opening direction, i.e., downwardly by compressing the valve springs 11 and 12 without compressing lifter springs 58 and 59**.

The lower half part of the hollow cylinder portion 55 of the supporting cylinder 52 is formed with a large diameter in which the annular electromagnetic body 51 is contained and fixed by a bolt 62 to the inner wall step 55*a* of the hollow cylinder portion 55. The electromagnetic body 51 together with the magnetic body 9 comprises the electromagnetic actuator A. The contacting portion of the upper end of the valve stem portion 5*a* of the intake valve 5 with the protrusion pin 61 integral with the lifter lower portion 57 extends into the hollow inner portion of the electromagnetic body 51. The upper surface of the magnetic body 9 which is used also as the spring retainer faces the attracting surface of the lower surface of the electromagnetic body 51, and the magnetic body 9 is attracted thereby by the energization of the electromagnetic body 51. The attracting force of the electromagnetic actuator A and the spring forces of the valve springs 11 and 12 in combination are stronger than the resilient forces of the lifter springs 58 and 59. Accordingly, when the electromagnetic body 51 is energized, the intake valve 5 is held in the closed position irrespective of the rotation of the valve operating cam shaft 14 and the valve opening force by the intake cam 15 is accumulated in the lifter springs 58 and 59. As shown in FIG. 3, when the intake valve 5 is in its valve closed position, a predetermined small gap is formed between the electromagnetic body 51 and the electromagnetic body 9, and between the base circle of the intake cam 14 and the upper surface of the lifter upper portion 57 to assure that the valve 5 is completely closed on the seat 7.

The control circuit C which operates as a result of detecting the operating state of the engine is connected to the solenoid of the electromagnetic body 51 to provide a signal from the control circuit C to energize or de-energize the electromagnetic body 51.

An annular hydraulic pressure chamber 63 is formed between the outer peripheral surface of the lifter lower portion 56 and the inner peripheral wall of the supporting cylinder 52 in the valve drive means 16. An oil supply port 64 and an oil exhaust port 65 are provided in the wall of the supporting cylinder 52 and communicate with the hydraulic pressure chamber 63. A hydraulic pressure circuit, such as, for example, a lubricating oil circuit of the engine E communicates with the hydraulic pressure chamber 63 for circulating hydraulic oil through the chamber 63. The hydraulic oil flowing into the hydraulic pressure chamber 63 acts on the downwardly facing pressure receiving surface 66 formed on the outer peripheral surface of the lifter lower portion 56 to apply buffering action and lubrication to the valve drive means 16 when the valve drive means 16 lifts the valve 5.

The operation of the first embodiment of this invention now will be described by referring to FIGS. 4(*a*), 4(*b*), 4(*c*), 5 and 6. When the valve operating cam shaft 14 is rotated cooperatively with the crankshaft, the intake valve 5 is opened and closed at a predetermined timing by the cooperation of the intake valve cam 15 and the valve springs 11 and 12. The normal valve opening lifting distance of the intake valve 5 with respect to the rotating angle of the valve operating cam shaft 14 is shown as a lifting curve by a one-dot broken line in FIGS. 4(*a*) and 4(*b*).

When the opening and closing operations of the solenoid valves 40 and 42 are controlled by the control circuit C to control the hydraulic pressure in the hydraulic pressure chamber 26 in the phase control means 17, the piston 27 is axially moved in response to the hydraulic pressure to vary the rotating phase of the crankshaft and the valve operating cam shaft 14. Accordingly, as shown in FIG. 4(*a*), the valve opening lifting curve can be displaced in either direction with respect to the rotating angle of the crankshaft as designated by the two solid lines with respect to the one-dot broken line showing the lifting curve in the state that the phase is not displaced.

Further, the valve opening timing of the intake valve 5 can be varied as shown in FIG. 4(*b*) with respect to the rotating angle of the valve operating cam shaft 14 by the valve drive means 16. More specifically, when the engine is in a specific operating state, such as, for example, in its low load operating state, the magnetic body 9 is attracted to the electromagnetic body 51 by energizing the latter under the control of the control circuit C while the base circle of the intake cam 15 abuts against the lifter upper portion 57 as shown in FIG. 3, i.e., before the intake valve 5 is lifted. Then, when the intake cam lobe surface contacts the lifter upper portion 57 by the rotation of the intake cam 15 as shown in FIG. 5, a downward pressing force acts on the valve drive means 16 but since the attracting force of the electromagnetic body 51 and the spring forces of the valve springs 11 and 12 are stronger than the resilient forces of the lifter springs 58 and 59, as described above, the valve drive means 16 itself is merely compressed while the lifter springs 58 and 59 are being compressed and the intake valve 5 remains held at the valve closed position while the valve opening force is accumulate by the lifter springs 58 and 59.

When the valve operating cam shaft 14 continues to rotate so that its rotating angle arrives, for example, in the vicinity of a point P in FIG. 4(*b*), namely, at a position immediately before the lifting distance becomes maximum by the intake cam 15, if the energization of the electromagnetic body 51 is interrupted by the control circuit C, then the attracting force on the magnetic body 9 is interrupted and the resilient forces of the lifter springs 58 and 598 abruptly open the intake valve 5 as shown in FIG. 6 and by the vertical line from point P in FIG. 4(*b*). As a result, the valve opening lifting distance is linearly increased. Thus, mixture gas flowing in the intake system immediately flows into the combustion chamber 2. If the engine is in an air-intake stroke wherein the piston is moving downwardly and the intake valve 5 is closed as shown in FIG. 5, the combustion chamber 2 is subjected to a much higher negative pressure than the conventional pressure due to the downward movement of the piston with the valve 5 opening normally. When the intake valve 5 is immediately opened in this state as shown in FIG. 6, the intake gas flowing from the intake system to the combustion chamber 2 creates a supercharging state by reason of the high inertial effect of the moving intake gas to supply increased intake gas into the combustion chamber to perform the supercharging effect in a low load operating state, thereby obtaining an increase in the output of the engine.

After the lifting distance of the intake valve 4 becomes maximum, the valve is closed along a normal lifting curve by the cooperation of the intake cam 15 and the valve springs 11 and 12 as shown in the right hand portion of FIG. 4(*b*).

The controlled valve closing operation by the electromagnetic actuator A can be performed for any selected timing as shown by solid lines in FIG. 4(*b*) regardless of the cam shaft operating state. More specifically, the valve opening timing can be selectively altered from immediately after the start of the cam lifting to just after the maximum lifting of the cam, as shown by the six vertical lines in FIG. 4(*b*), as well as at any time before the end of the cam lifting. Further, if the electromagnetic actuator A is always deenergized, opening and closing timing along a cam profile can be obtained without displacement of the lifter springs 59 and 59. In addition, if the energization of the electromagnetic actuator A is continued during the entire cam lifting portion of the cam profile, the valve closed state can be also obtained for disabling that cylinder or one if plural valves in that cylinder.

As described above, the rotating phase of the crankshaft and the valve operating cam shaft 14 is controlled by the phase control means 17 and the valve closed position of the intake valve 5 is maintained by the electromagnetic actuator A in the valve drive means 16 to control the valve opening timing of the intake valve 5 with respect to the valve opening cam shaft 14. The valve opening and closing states of the intake valve 5 can be varied in a wide range as shown in FIG. 4(*c*) by combining both of these controls to largely increase the degree of freedom of valve control.

FIGS. 7 through 11 show a second embodiment of the present invention, where the components corresponding to those in the first embodiment are designated by the same reference numerals as those in the first embodiment. Valve drive means 70 for transmitting a valve opening force cf the intake cam 15 to the intake valve 5 is interposed between the intake cam 15 and the intake valve 5. The valve drive means 70 comprises a rocker shaft 71 mounted in parallel above the valve operating cam shaft 14 between the valve operating cam shaft 14 and the intake valve 5, a first rocker arm 72 supported on the rocker shaft 71 to pivotally abut against the intake cam 15, a second rocker arm 73 supported on the rocker shaft 71 to pivotally abut against the upper end of the intake valve 5, and torsional springs 74 and 74 as valve opening resilient members interposed between the rocker arms 72 and 73 for generating resilient valve opening forces for the intake valve 5.

A collar 76 is attached to the rocker shaft 71 through a cylindrical slidable metal sleeve 75. The colar 76 is in a basically cylindrical shape and retaining rings 77 a nd 77 abut against both ends of the collar 76 and are fitted in the slidable metal sleeve 76 to hold the collar 76 in position. Drum portions 76*a* and 76*a* are provided at both axial ends of the collar 76 for winding the torsional springs 74 and 74 on the collar 76. The base ends of the first and second rocker arms 72 and 73 are rotatably supported between the drum portions 76*a* and 76*a* near the center of the collar 76.

The first rocker arm 72 extends from the rocker shaft 71 to the intake cam 15 and the cam surface of the intake cam 15 slidably abuts against the lower surface of the leading end of the first rocker arm 72. The second rocker arm 73 extends from its base portion on the rocker shaft 71 to the intake valve 5 while slidably abutting against the side of the base portion of the first rocker arm 72. A tappet screw 78 on the end of rocker arm 73 engages the upper end of the valve stem portion 5*a* of the intake valve 5. A retaining nut 79 on the tappet screw 78 engages the upper surface of the end of the second rocker arm 73 to maintain the adjusted position of the tappet screw 78.

Connecting pins 80 and 81 parallel to the rocker shaft 71 are fixed to the first and second rocker arms 72 and 73, respectively, and protrude in both lateral directions. One end of each of the torsional springs 74 and 74 that are wound on the drum portions 76*a* and 76*a*, respectively, of the collar 76 are fitted on the connecting pin 80 of the first rocker arm 72 and the other end of each of the torsional springs 74 and 74 are fitted on the connecting pin 81 of the second rocker arm 73. Thus, the first and second rocker arms 72 and 73 are urged in the direction to turn the first rocker arm 72 toward the intake cam 15 and to turn the second rocker arm 73 toward the intake valve 5. The resilient forces of both the torsional springs 74 and 74 are selected to be stronger than those of the valve springs 11 and 12. Accordingly, when the valve operating cam shaft 14 is rotated, the intake cam 15 presses the intake valve 5 downwardly through the valve drive means 70 to slide the valve in the valve opening direction, i.e., downwardly.

An annular electromagnetic body 51 facing the upper surface of the spring retainer 9 and enclosing the valve stem portion 5*a* of the intake valve 5 is fixed to the cylinder head 1, and the electromagnetic body 51 together with the magnetic body 9 comprises an electromagnetic actuator A. The attracting force of the electromagnetic actuator A and the spring forces of the valve springs 11 and 12 are selected to be stronger than the resilient forces of the torsional springs 74 and 74. The electromagnetic body 51 is provided with a through hole 84 comprising the coaxially connected small-diameter hole 82 slidably engaging the valve stem portion 5*a* of the intake valve 5 and large-diameter hole 83 having a larger diameter than that of the small-diameter hole 82. The valve stem portion 5*a* of the intake valve 5 extends axially through hole 84.

An annular recess 85 is formed in the inner surface of the intermediate portion of the large-diameter hole 83 in the through hole 84 of the electromagnetic body 51. A cap-shaped valve piece 86 is slidably fitted in the large-diameter hole 83 of the through hole 84 and fits over the upper end of the valve stem portion 5*a* inserted through hole 84. When the intake valve 5 is closed the upper portion of the valve piece 86 protrudes upwardly beyond the upper end of the through hole 84 and the tappet screw 78 abuts against the valve piece 86. An oil supply hole 87 communicates the annular recess 85 of the through hole 84 in the electromagnetic body 51 with an oil supply source (not shown).

With the valve drive means 70, when the intake valve 5 is held in its closed position by the electromagnetic actuator A in the state where the base circle portion of the intake cam 15 slidably abuts against the first rocker arm 72, the first rocker arm 72 is pivoted clockwise in FIG. 7 in response to the fact that the lobe portion of the intake cam 15 slidably abuts against the first rocker arm 72 and its rotary force is transmitted through the torsional springs 74 and 74 to produce a clockwise pressing force on the second rocker arm 73. In this case, since the attracting force of the electromagnetic actuator A and the spring forces of the valve springs 11 and 12 are stronger than the resilient forces of the torsional springs 74 and 74, the pivoting of the second rocker arm 73 is stopped and the torsional springs 74 a nd 74 are coiled tighter to allow pivoting of only the first rocker arm 72, as shown in FIG. 10. Thus, the intake valve 5 is held in its closing position and the valve opening force of the intake cam 15 is accumulated by the torsional springs 74 and 74.

If the holding by the electromagnetic actuator A is released during holding the closed position of the intake valve 5 in this manner, the valve opening force accumulated at the torsional springs 74 and 74 is abruptly released and the intake valve 5 is abruptly opened by the resilient forces of the torsional springs 74 and 74 are shown in FIG. 11. Further, when the valve piece 86 slidably enters the lower portion of the large-diameter hole 83 of the through hole 84 during this opening of the valve, the hydraulic oil is enclosed between the step extending between the large-diameter hole 83 and the small-diameter hole 82 and the end surface of the valve piece 86, whereby the downward movement of the valve piece 86 and the valve stem portion 5*a* is restrained and controlled by the slight leakage of the hydraulic pressure from between the small-diameter hole 82 and the valve stem portion 5*a* as well as between the valve piece 86 and the large-diameter hole 83 and an impact buffering action is provided at the time of opening the valve.

Similar advantages as those of the first embodiment can be performed by the combination of the valve drive means 70 of this second embodiment and the phase control means 17 of the first embodiment.

FIGS. 12, 13 and 14 show a third embodiment of the present invention, wherein the components corresponding to those of the embodiments described above are designated by the same reference numerals as those in the previous embodiments. A valve drive means 75 is interposed between an intake valve 5 and an intake cam 15. The valve drive means 95 comprises a rocker arm 96 rotatably supported on a rocker shaft 71 and slidably engaging the intake cam 15, a slidable plunger 97 supported in the rocker arm 96 and slidably abutting against the upper end of the valve stem portion 5*a* of the intake valve 5, and torsional springs 98 and 98 as resilient valve opening members interposed between the rocker arm 96 and the slidable plunger 97.

The rocker arm 96 is supported on the rocker shaft 71 through a collar 99. A cylindrical stopper 100 is slidably fitted in the rocker arm 96 to define the lowermost position of the slidable plunger 97 with respect to the rocker arm 96 and is threadedly connected to the slidable plunger 97 in such a manner that the axial relative position with respect to the slidable plunger 97 is variable. A retaining nut 101 is threadedly connected to the plunger 97 for fixing the relative position to the stopper 100. Specifically, the rocker arm 96 is provided with a coaxially connected large-diameter hole 102 and a small-diameter hole 103 and the stopper 100 is provided with a large-diameter portion 100*a* slidably fitted in the large-diameter hole 102 and a small-diameter portion 100*b* slidably fitted in the small-diameter hole 103. Further, a step between the large-diameter portion 100*a* and the small-diameter portion 100*b* abuts against a step between the large-diameter hole 102 and the small-diameter hole 103 to define the lowermost limit position of the stopper 100, i.e., the slidable plunger 97 relative to the rocker arm 96. Further, hydraulic pressure is supplied to the annular chamber 104 defined between the rocker arm 96 and the stopper 100 to perform a buffering action at the time of sliding the slidable plunger 97 downwardly.

An arm member 106 is fixed to the lower portion of the slidable plunger 97 through a cotter 105. The arm member 106 has a disc portion 106*a*, and pin-shaped connecting portions 106*b* and 106*b* protruding along a radial line from the disc portion 106*a* and the cotter 105 is press-fitted to a wedge hole 107 formed in the center of the disc portion 106*a* with a smaller diameter at the top to fix the arm member 106 to the slidable plunger 97.

One end of each of the torsional springs 98 and 98 are engaged with a connecting pin 108 fixed to and protruding laterally from the rocker arm 96 on both sides in parallel with the rocker shaft 71 and the other end of each of the torsional springs 98 and 98 are engaged with the connecting portions 106*b* and 106*b* of the arm member 106. The torsional springs 98 and 98 generate resilient forces in the direction for the rocker arm 96 to slidably abut against the intake cam 15 and the slidable plunger 97 to abut against the intake valve 5.

The remaining construction of this third embodiment is the same as those of the first and second embodiments, such as, an electromagnetic actuator A is comprised of the upper surface of a spring retainer 9 and an electromagnetic body 51, and the attracting force of the electromagnetic actuator A and the spring forces of valve springs 11 and 12 are selected to be larger than the resilient forces of the torsional springs 98 and 98.

According to the third embodiment, the intake valve 5 can be held in its closed state by the electromagnetic actuator A, and the valve opening timing of the intake valve 5 can be controlled by controlling the timing for releasing the hold state. Accordingly, the same advantages as those of the embodiments described above can be provided by combining valve drive means 95 with the phase control means 17 of the first embodiment.

As still a further embodiment of the present invention, the rocker arm in the embodiment in FIGS. 12 to 14 may abut against the intake valve and the slidable plunger supported on the rocker arm may abut against the intake cam.

In the embodiments described above, the system of the present invention described as being applied to the intake valve opening and closing mechanism of the internal combustion engine. However, the present invention may also be applied to an exhaust valve opening and closing mechanism.

According to the present invention as described above, there is provided a valve operation control system of an internal combustion engine having valve drive means interposed between a valve operating cam and an engine valve and a phase control means interposed between a crankshaft and the valve operating cam shaft to control the rotating phase of the crankshaft and the valve operating cam shaft, wherein the valve drive means comprises a resilient valve opening means for generating a resilient force in the valve opening direction of the engine valve and holding means interposed between the engine valve and the valve operating cam for holding the engine valve in a valve closed position while accumulating the valve opening force by the valve operating cam in the resilient valve opening means. The holding means is constructed to be able to switch between the holding state and the hold-releasing state so as to control the valve opening timing of the engine valve in response to the operating condition of the engine. Therefore, the degree of freedom of controlling the valve operation is greatly increased by combining the valve opening timing control of the engine valve under the controls of the phase of the crankshaft and the valve operating cam shaft by the phase control means and the hold releasing timing of the holding means

THE INVENTION CLAIMED IS:

1. A ValVe operation control system for an internal combustion engine having an engine valve supported in an engine body for opening and closing, a valve spring for biasing said engine valve in a valve closing direction, valve drive means interposed between a valve operating cam and the engine valve as to transmit a valve opening force by the valve operating cam provided on a valve operating cam shaft to the engine valve, and phase control means interposed between a crankshaft and the valve operating cam shaft to vary the rotating phase of the crankshaft relative to the valve operating cam shaft, wherein said valve drive means includes a resilient valve opening means for generating a resilient force in the valve opening direction of said engine valve, and holding means interposed between said engine valve and said valve operating cam for holding said engine valve in a valve closed position while accumulating the valve opening force by the valve operating cam in said resilient valve opening means, said holding means including means for selectively switching between a valve holding state and a hold-releasing state so for controlling the valve opening timing of said engine valve in response to an operating condition of the engine.

2. A valve operation control system for an internal combustion engine according to claim 1, wherein said holding means includes an electromagnetic actuator.

3. A valve operation control system for an internal combustion engine according to claim 1, wherein said valve drive means includes a resilient valve opening member having resilient means interposed between an upper portion of a lifter operatively engaging the valve operating cam and the lower portion of the lifter operatively engaging the engine valve and slidably telescoping with the upper portion of said lifter.

4. A valve operation control system for an internal combustion engine according to claim 1, wherein said valve drive means includes a resilient valve opening member having resilient means interposed between a first rocker arm operatively engaging the valve operating cam and a second rocker arm operatively engaging the engine valve, said first and second rocker arms being pivotable about a common axis.

5. A valve operation control system for an internal combustion engine according to claim 1, wherein said valve drive means includes a resilient valve opening member having resilient means interposed between a rocker arm slidably engaging the valve operating cam and a slidable plunger slidably fitted in said rocker arm and operatively engaging the engine valve.

6. A valve operation control system for an internal combustion engine according to claim 1, wherein said valve drive means includes means for damping the opening movement of the engine valve when the holding means is switched from said holding state to said hold-releasing state in a condition with accumulated valve opening force.

7. A valve operation control system for an internal combustion engine according to claim 6, wherein said damping means includes hydraulic piston and cylinder means for slowly exhausting hydraulic oil therefrom as the accumulated valve opening force is transmitted to the engine valve.

8. A valve operation control system for an internal combustion engine according to claim 1, wherein said holding means includes a retainer mounted on the engine valve for retaining the valve spring and an electromagnet mounted adjacent the valve closed position of said retainer for selective maintaining the valve closed position by electromagnetic attraction with said retainer.

9. A valve operation control system for an internal combustion engine according to claim 8, wherein said electromagnet is annular in shape and encircles at least a portion of the engine valve.

10. A valve operation control system for an internal combustion engine according to claim 1, wherein a cam follower means including a pivotally mounted cam follower is operatively connected between the valve operating cam and the engine valve for operating the engine valve, said cam follower means a lost-motion means for allowing said accumulating of the valve opening force.

11. A valve operation control system for an internal combustion engine having an engine valve supported in an engine body for opening and closing, a valve spring for biasing said engine valve in a valve closing direction, phase control means interposed between the crankshaft and the valve operating cam shaft to vary the rotating phase of the crankshaft relative to the valve operating cam shaft, a cam shaft with a valve operating cam, and a crankshaft for rotating the cam shaft, comprising, valve drive means interposed between the valve operating cam and the engine valve for transmitting a valve opening force by the valve operating cam to the engine valve, said valve drive means including a resilient valve opening means for generating a resilient force in the valve opening direction of said engine valve and holding means interposed between said engine valve and said valve operating cam for holding said engine valve in a valve closed position while accumulating the valve opening force by the valve operating cam in said valve opening resilient means, said holding means being selectively operable to switch between a holding state and a hold-releasing state to control the valve opening timing.

* * * * *